US007698916B2

(12) United States Patent
Davis

(10) Patent No.: US 7,698,916 B2
(45) Date of Patent: Apr. 20, 2010

(54) LOCK

(75) Inventor: Paul Davis, Corvallis, OR (US)

(73) Assignee: Videx, Inc., Corvallis, OR (US)

( * ) Notice: Subject to any disclaimer, the term of this patent is extended or adjusted under 35 U.S.C. 154(b) by 0 days.

(21) Appl. No.: 12/079,498

(22) Filed: Mar. 26, 2008

(65) Prior Publication Data

US 2008/0178640 A1 Jul. 31, 2008

Related U.S. Application Data

(63) Continuation of application No. 11/212,894, filed on Aug. 26, 2005, now abandoned.

(51) Int. Cl.
*E05B 67/36* (2006.01)

(52) U.S. Cl. ..... 70/34; 70/367; 70/373; 70/386

(58) Field of Classification Search ..... 70/32–34, 70/278.3, 278.7, 386, 367, 369, 373–375
See application file for complete search history.

(56) References Cited

U.S. PATENT DOCUMENTS

| | | | |
|---|---|---|---|
| 1,564,463 | A | 12/1925 | Best |
| 1,654,752 | A | 1/1928 | Raleigh |
| 2,082,806 | A | 6/1937 | Michel |
| 2,124,936 | A | 7/1938 | Wehrs |
| 2,763,888 | A | 9/1956 | Billeter |
| 2,855,588 | A | 10/1958 | Allen |
| 3,093,994 | A | 6/1963 | Richard |
| 3,134,254 | A | 5/1964 | Richard |
| 3,206,595 | A | 9/1965 | Best |
| 3,332,713 | A | 7/1967 | DeClaire et al. |
| 3,392,558 | A | 7/1968 | Hedin et al. |
| 3,403,380 | A | 9/1968 | Welch |
| 3,404,549 | A | 10/1968 | Best |
| 3,418,833 | A | 12/1968 | Kerr |
| 3,508,031 | A | 4/1970 | Cooper, Jr. |
| 3,509,748 | A | 5/1970 | Trainor |
| 3,641,396 | A | 2/1972 | Kossen et al. |
| 3,651,464 | A | 3/1972 | Hedin et al. |
| 3,660,729 | A | 5/1972 | James et al. |
| 3,731,963 | A | 5/1973 | Pond |
| 3,733,861 | A | 5/1973 | Lester |
| 3,798,935 | A | 3/1974 | Blekking et al. |
| 3,843,174 | A | 10/1974 | Bogunovich et al. |
| 3,854,310 | A | 12/1974 | Paul et al. |
| 3,859,634 | A | 1/1975 | Perron et al. |
| 3,872,435 | A | 3/1975 | Cestaro |
| 3,939,679 | A | 2/1976 | Barker et al. |
| 3,944,976 | A | 3/1976 | France |
| 3,953,991 | A | 5/1976 | Grossman |
| RE29,259 | E | 6/1977 | Sabsay |
| RE29,341 | E | 8/1977 | Peters et al. |

(Continued)

FOREIGN PATENT DOCUMENTS

| | | |
|---|---|---|
| DE | 44 10 783 C1 | 4/1995 |

(Continued)

*Primary Examiner*—Suzanne D Barrett
(74) *Attorney, Agent, or Firm*—Chernoff, Vilhauer, McClung & Stenzel, LLP

(57) ABSTRACT

A lock with a core rotatable in an intermediate shell that is rotatable in an outer shell of the lock's body resists attack by the application of excessive torque to the keyway or drilling into the core.

16 Claims, 5 Drawing Sheets

U.S. PATENT DOCUMENTS 4,040,279 A 8/1977 Signorelli et al.
4,049,313 A 9/1977 Lundberg
4,051,548 A 9/1977 Hamada
4,083,424 A 4/1978 von den Stemmen et al.
4,099,752 A 7/1978 Geringer
4,127,966 A 12/1978 Schmidt
4,148,092 A 4/1979 Martin
4,157,534 A 6/1979 Schachter
4,193,276 A 3/1980 Lundberg
4,201,887 A 5/1980 Burns
4,209,782 A 6/1980 Donath et al.
4,262,504 A 4/1981 Inoue
4,294,093 A 10/1981 Best et al.
4,317,157 A 2/1982 Eckloff
4,353,064 A 10/1982 Stamm
4,428,211 A 1/1984 Hermann
4,525,805 A 6/1985 Prosan et al.
4,557,121 A 12/1985 Charlton
4,578,969 A 4/1986 Larson
4,579,376 A 4/1986 Charlton
4,594,637 A 6/1986 Falk
4,603,564 A 8/1986 Kleinhäny et al.
4,626,007 A 12/1986 Larson
4,631,939 A 12/1986 Herriott
4,633,688 A 1/1987 Beudat et al.
4,702,094 A 10/1987 Peterson
4,712,398 A 12/1987 Clarkson et al.
4,727,368 A 2/1988 Larson et al.
4,732,022 A 3/1988 Oliver
4,744,021 A 5/1988 Kristy
4,766,746 A 8/1988 Henderson et al.
4,771,620 A 9/1988 Kleinhäny
4,789,859 A 12/1988 Clarkson et al.
4,798,068 A 1/1989 Nakauchi
4,810,861 A 3/1989 Herriott et al.
4,829,296 A 5/1989 Clark et al.
4,831,851 A 5/1989 Larson
4,838,051 A * 6/1989 Yang ..... 70/38 A
4,856,310 A 8/1989 Parienti
4,870,400 A 9/1989 Downs et al.
4,887,292 A 12/1989 Barrett et al.
4,895,036 A 1/1990 Larson et al.
4,896,246 A 1/1990 Henderson et al.
4,909,053 A 3/1990 Zipf, III et al.
4,914,732 A 4/1990 Henderson et al.
4,916,443 A 4/1990 Barrett et al.
4,916,927 A 4/1990 O'Connell et al.
4,929,880 A 5/1990 Henderson et al.
4,936,894 A 6/1990 Larson et al.
4,947,163 A 8/1990 Henderson et al.
4,962,449 A 10/1990 Schlesinger
4,982,587 A 1/1991 Tzou
4,988,987 A 1/1991 Barrett et al.
5,010,750 A 4/1991 Böser et al.
5,046,084 A 9/1991 Barrett et al.
5,090,222 A 2/1992 Imran
5,136,869 A 8/1992 Best
5,140,317 A 8/1992 Hyatt, Jr. et al.
5,148,690 A * 9/1992 Wang ..... 70/38 A
5,177,988 A 1/1993 Bushnell
5,181,406 A 1/1993 Wolter
5,193,372 A 3/1993 Sieg et al.
5,216,909 A 6/1993 Armoogam
5,245,329 A 9/1993 Gokcebay
5,245,652 A 9/1993 Larson et al.
5,267,460 A 12/1993 Burleigh
5,280,518 A 1/1994 Danler et al.
5,319,362 A 6/1994 Hyatt, Jr.
5,335,520 A 8/1994 Lee
5,339,662 A 8/1994 Goldman
5,361,614 A 11/1994 Metcalf
5,367,295 A 11/1994 Gokcebay et al.
5,421,178 A 6/1995 Hamel et al.
5,475,375 A 12/1995 Barrett et al.
5,507,162 A 4/1996 Chhatwal
5,542,274 A 8/1996 Thordmark et al.
5,550,529 A 8/1996 Burge
5,552,777 A 9/1996 Gokcebay et al.
5,582,050 A 12/1996 Häggström
5,602,536 A 2/1997 Henderson et al.
5,609,051 A 3/1997 Donaldson
5,654,696 A 8/1997 Barrett et al.
5,664,449 A 9/1997 Sedley
5,705,991 A 1/1998 Kniffin et al.
5,745,044 A 4/1998 Hyatt, Jr. et al.
5,768,921 A 6/1998 Hill
5,791,177 A 8/1998 Bianco
5,794,465 A 8/1998 Hill
5,826,450 A 10/1998 Lerchner et al.
5,839,307 A 11/1998 Field et al.
5,856,771 A 1/1999 Nippert
5,902,209 A 5/1999 Moody
5,911,401 A 6/1999 Hrytzak et al.
5,987,940 A * 11/1999 Chang ..... 70/38 A
6,000,609 A 12/1999 Gokcebay et al.
6,005,487 A 12/1999 Hyatt, Jr. et al.
6,012,311 A 1/2000 Duckwall
6,082,153 A 7/2000 Schoell et al.
6,085,560 A 7/2000 Dalton, Jr.
6,125,673 A 10/2000 Luker
6,155,089 A 12/2000 Hurskainen et al.
6,334,347 B1 1/2002 Iscla
6,386,006 B1 5/2002 DeWalch
6,402,181 B1 6/2002 Lee
6,474,122 B2 11/2002 Davis
6,543,260 B2 4/2003 Koy et al.
6,564,600 B1 5/2003 Davis
6,564,601 B2 5/2003 Hyatt, Jr.
6,604,394 B2 8/2003 Davis
6,615,625 B2 9/2003 Davis
6,718,806 B2 4/2004 Davis
6,758,073 B2 * 7/2004 Yu ..... 70/358
6,854,302 B2 2/2005 Zapushek et al.
6,862,905 B2 3/2005 Zapushek
6,895,792 B2 5/2005 Davis
6,913,413 B2 7/2005 Yang
6,981,396 B1 * 1/2006 Kim ..... 70/495
2007/0137266 A1 6/2007 Hsai
2007/0180871 A1 8/2007 Irgens et al.

FOREIGN PATENT DOCUMENTS

EP 0128991 12/1984
EP 0290330 8/1989
GB 1 525 033 9/1976
GB 2024922 A 1/1980
GB 2 119 548 A 11/1983
WO WO 01/00956 A1 4/2001

* cited by examiner

LOCK

CROSS-REFERENCE TO RELATED APPLICATIONS

This application is a continuation of application Ser. No. 11/212,894, filed Aug. 26, 2005, now abandoned.

BACKGROUND OF THE INVENTION

The present invention relates to a lock and, more particularly, to a lock providing improved security and resistance to attack.

The primary function of a lock is to deter individuals seeking unauthorized access to property. A lock typically comprises a core, sometimes referred to as a cylinder or a plug, which is selectively rotatable in the lock's body or casing to releasably secure a bolt or shank to the body of the lock. Typically, one or more locking pin(s), movable in the core, are arranged to selectively engage the body and prevent the core from turning in the body unless a correctly coded input moves the locking pin(s) to a position enabling rotation of the core. In a pin tumbler lock, for example, the locking pins comprise tumbler stacks which extend across the shear line separating the rotatable core from the body. When a correctly bitted key is inserted into the keyway, the tumbler stacks are moved to positions where the separation between the top and bottom tumblers of the stacks are all aligned with the shear line enabling rotation of the core and release of the bolt. Pin tumbler locks may be attacked by "picking," mechanically manipulating the tumblers to their unlocked positions, permitting the lock to be operated without access to the correct key.

The correctly coded input for an electronic lock is typically a sequence of electrical signals transferred between the lock and a key. The sequence of signals is typically interpreted by a logic unit of the lock, or logic units of the lock and the key, and if the sequence matches a correct sequence, an actuator is energized to release the bolt or shank from the body.

While electronic locks are not subject to attack by manual tumbler picking, they are subject to attack by other methods that are also used to attack mechanical locks. Manually operated locks, including electronic locks, typically comprise a keyway into which a key is inserted. If the key includes the correct code, the core is released and the user can rotate the unlocked core by applying torque to the key. A lock may be attacked by inserting an object into the keyway and applying torque to the keyway in an attempt to overload and fail the locking mechanism. Another method of attacking a lock is to drill into the face of the core to destroy the components of the locking mechanism and free the core to rotate and release the bolt. What is desired, therefore, is a lock that is resistant to attack by drilling into the core or by applying excessive torque to the keyway.

DETAILED DESCRIPTION OF PREFERRED EMBODIMENTS

Figure 1:
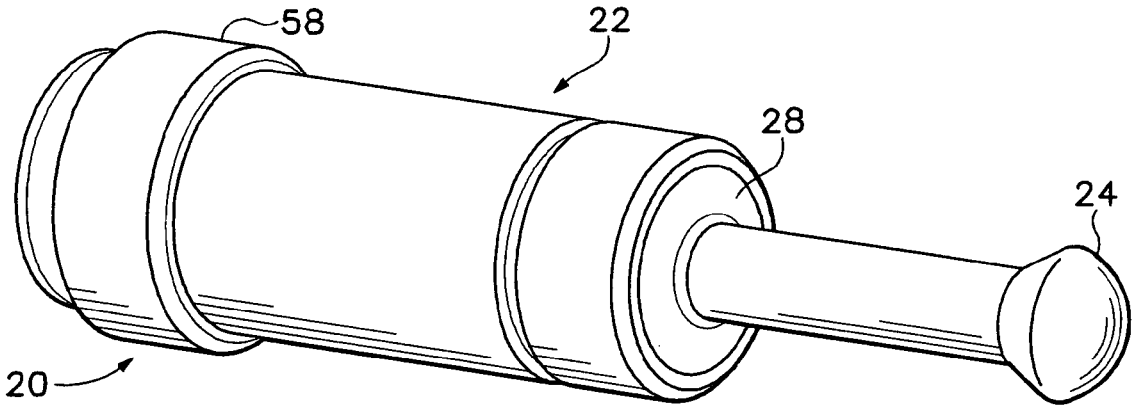
FIG. 1 is a perspective view of an exemplary lock.

A lock typically comprises a core that is selectively rotatable in the lock's body to release a bolt or shank that is securable to the body. Referring in detail to the drawings where similar parts are identified by like reference numerals, and, more particularly to FIGS. 1-5, an exemplary barrel lock 20 comprises a, typically, cylindrical body 22 and a bolt or shank 24 which can be selectively secured to or released from the body. Objects, for example a bicycle and a bicycle stand, may be secured to each other by wrapping a cable or other body to shank tether around the objects and securing the shank in the body. A barrel lock may also be used to secure an automotive receiver hitch by inserting the shank into co-aligned holes in the receiver and the drawbar and securing the body to the shank. Likewise, the shank of a barrel lock may be used as a pin in a hasp to secure the cover of a utility meter or the door of a shipping container. Similarly, a padlock comprises a U-shaped bolt that is permanently, but movably, secured to the body at one end and releasably securable to the body at the second end. In the case of cabinet, drawer or door locks, the bolt typically comprises a lever that is attached to the core of the lock and is selectively movable, for example by rotation, to selectively engage a strike plate affixed to the frame of the drawer or door.

The body 22 of the lock 20 comprises a hollow substantially cylindrical outer shell 26 that encloses most of the lock's components. The shank 24 is secured to the body by retention in an axially extending central aperture 30 in a socket 28 that is secured in one end of the outer shell. The socket 28 includes a first portion having a circular cross-section with external threads to engage mating internal threads on the interior of the hollow outer shell.

Figure 2:
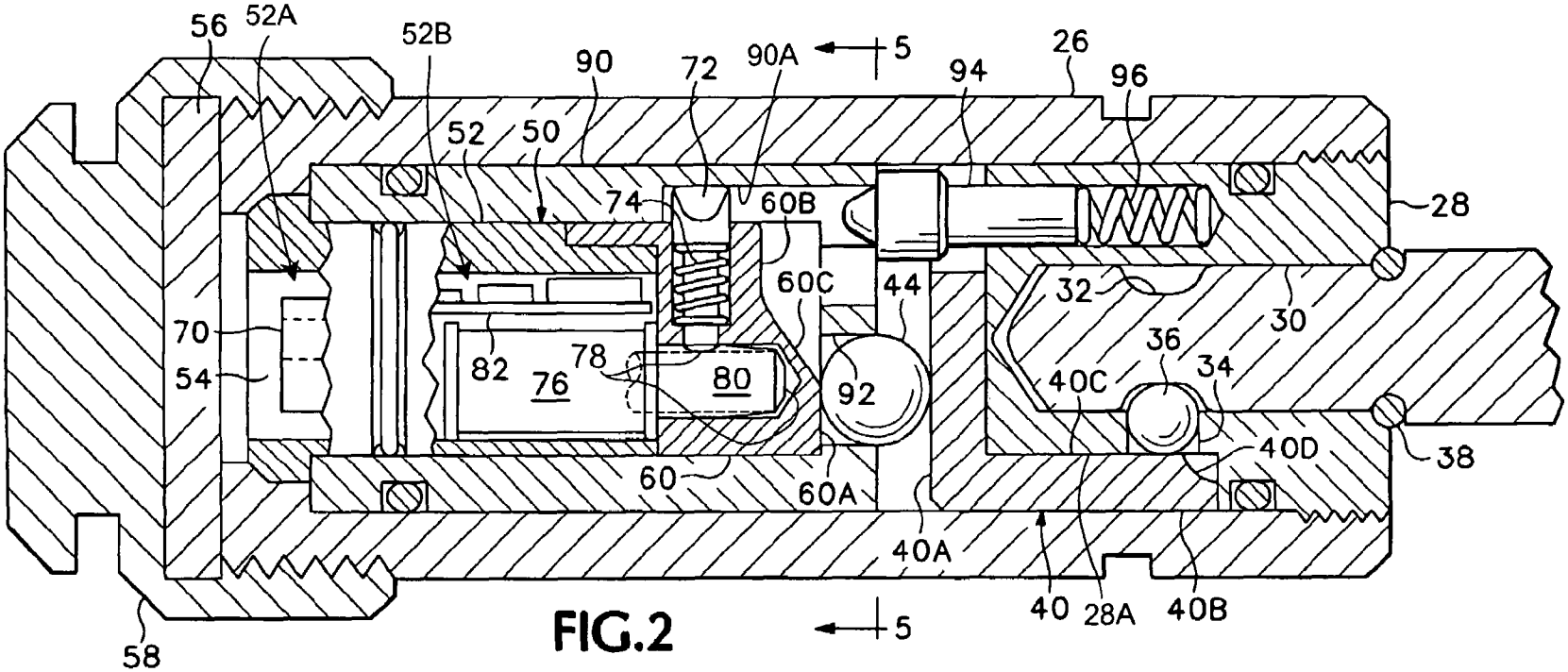
FIG. 2 is a longitudinal section of the lock of FIG. 1.
Figure 3:
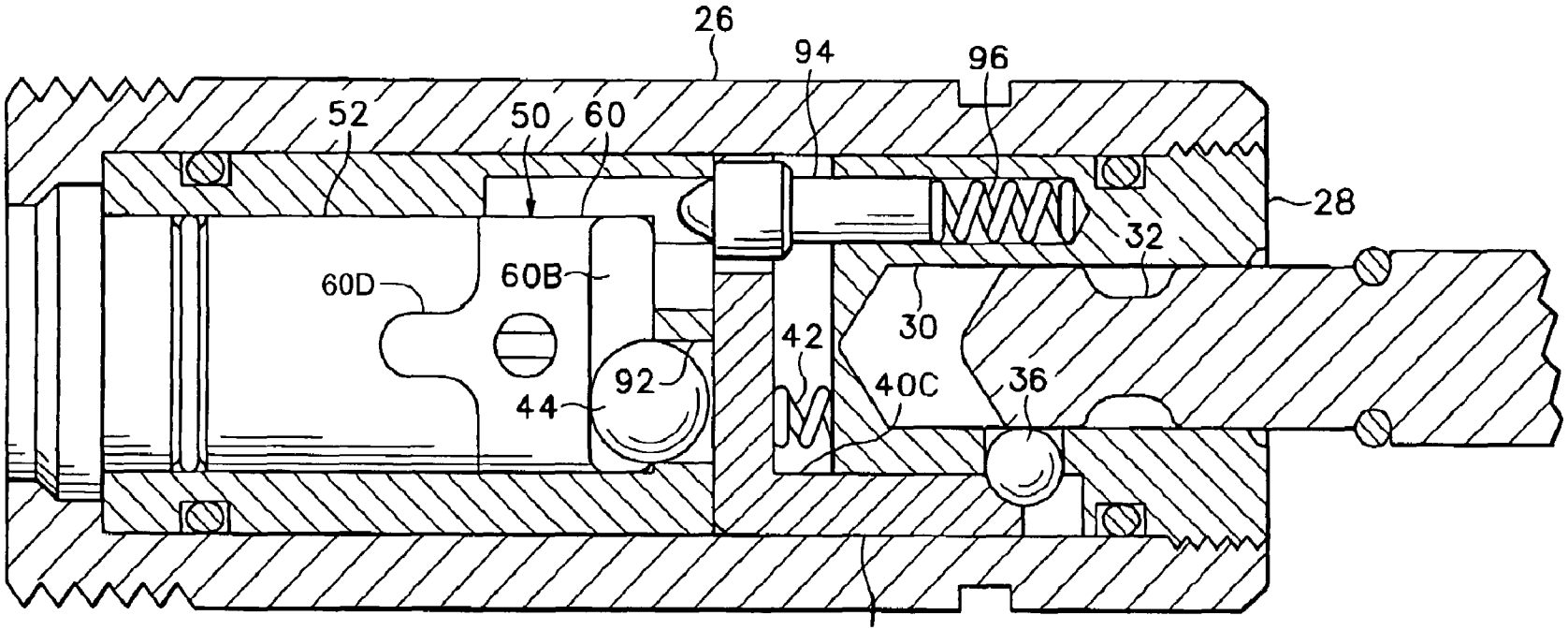
FIG. 3 is the longitudinal section of FIG. 2 illustrating rotation of the core of the lock of FIG. 1 to a shank releasing position.
Figure 4:
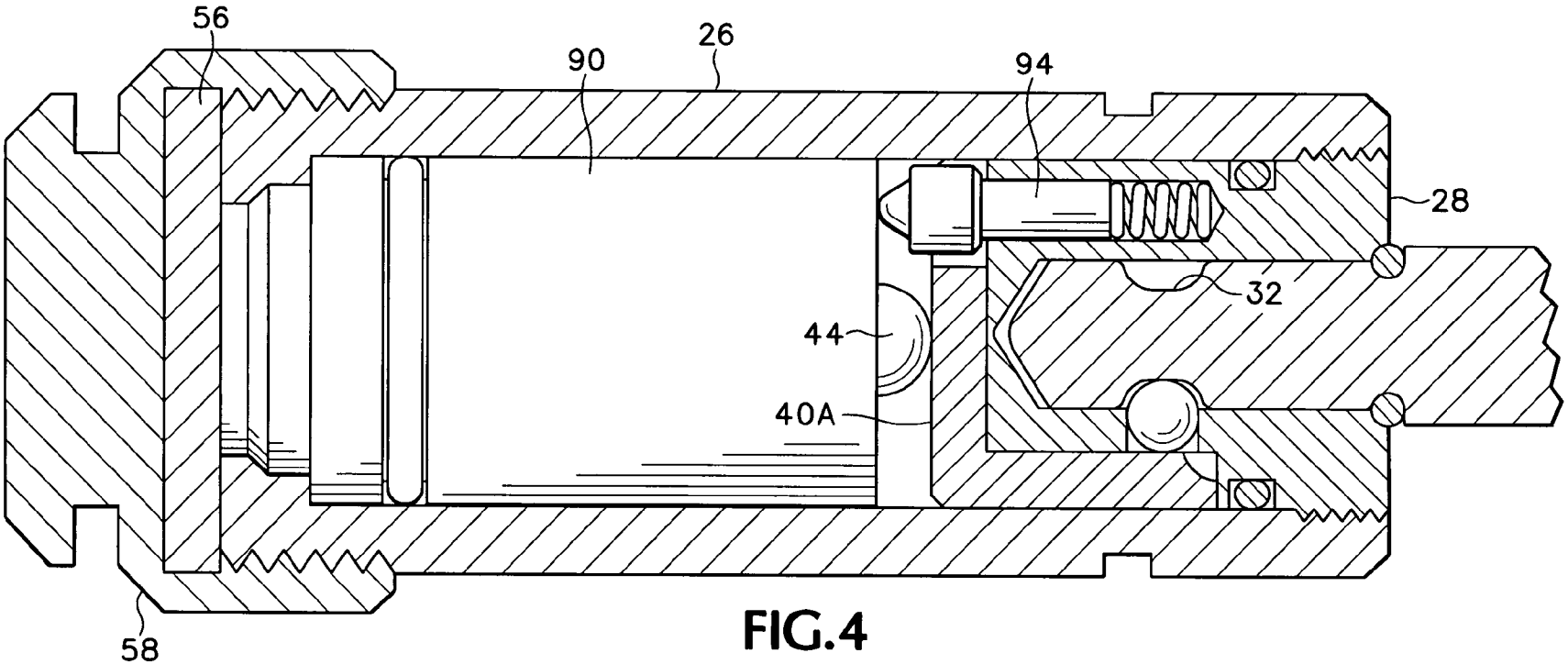
FIG. 4 is the longitudinal section of FIG. 2 illustrating rotation of an intermediate shell of the lock of FIG. 1.

The shank 24 is typically a hardened, cylindrical pin that may be tethered to the lock's body by a cable or other device. The shank 24 includes portions defining a circumferential groove 32 having a diameter that is reduced from the nominal diameter of the shank. Referring to FIG. 2, radially extending apertures 34 in the second portion of the socket connect the axial central aperture to the three external faces of the triangular second portion. A shank retaining ball 36, retained in each of the radially extending apertures 34 in the socket, is arranged to engage the groove 32 in the shank when the shank is inserted into the socket. The shank is secured in the body of the lock by preventing the radial displacement of the shank retaining balls 36 when the balls are in engagement with the groove 32. On the other hand, as illustrated in FIG. 3, the shank can be released from the body by permitting the shank retaining balls 36 to move radially outward and disengage from the groove 32 when the user of the lock moves the shank axially in the central aperture of the socket. An o-ring 38 on the shank protects the socket from dirt and moisture.

Radial displacement of the shank retaining ball is controlled by axial displacement of a spider 40 that is slidably arranged in the interior of the outer shell 26. The spider 40 comprises generally a disk portion 40A having substantially planar surfaces arranged normal to the longitudinal axis of the outer shell and a sector 40B that projects axially with the outer shell from one surface of the disk portion. To guide the axial movement of the spider in the outer shell, the disk and the axially projecting sector have curved external surfaces corresponding to the curvature of the internal diameter of the outer shell. The axially projecting sector includes an interior surface arranged adjacent to and movable relative to an exterior surface 28A of a second portion of the socket 28. The interior surface of the sector comprises a first surface 40C that is arranged substantially parallel to the adjacent surface of the socket and a second surface 40D comprising a relieved area located adjacent the end of the sector distal of the disk portion.

With the spider in a first or shank securing position, a shank retaining ball 36, retained in a radial aperture 34 in the socket 28, is prevented from moving radially outward, to disengage the groove in the shank, by the first interior surface 40C of the corresponding sector of the spider 40. Displacing the spider axially to a second or shank releasing position, where the respective relieved second surface 40D is aligned coincident with the radial aperture in the socket, permits the ball to move outward and disengage from the groove in the shank.

The axial position of the spider in the outer shell is varied by rotation of the lock's core. A spider return spring 42, located in an axially extending hole in the socket, bears against the disk portion of the spider to elastically urge axial movement of the spider toward the shank releasing position. However, a ball 44, functioning as a cam follower and engaging the planar surface of the disk portion of the spider, bears against one of the surfaces of a cam that comprises the rear surface of the lock core 50. The cam comprises a first cam surface 60A that is spaced axially apart from a second cam surface 60B and a ramp surface 60C connecting the first and second cam surfaces. When the core is rotated relative to cam follower ball 44, the ball to moves from the one surface of the cam to the other to axially displace the spider. When rotation of the cam causes the cam follower ball to engage with the surface axially farther from the socket, the spider return spring moves the spider axially to the shank releasing position. When the core 50 is rotated to move the cam follower ball 44 to the cam surface nearer the socket, the cam follower ball moves the spider against the elastic force of the spider return spring to the shank securing position.

The rotatable core 50 of the exemplary lock 20 comprises a substantially cylindrical back core 60 and a substantially hollow cylindrical front core 52. The front core 52 and the back core 60 are joined to rotate together by an axially extending projection 60D on the back core that engages a corresponding axial slot in the wall of the front core. The rearmost surface of the back core 60 comprises the surfaces 60A, 60B, 60C of the cam. The interior of the front core 52 is divided into front 52A and rear 528 portions. Most of the electrical components of the lock are housed within the rear portion of the hollow front core. The key is mechanically and electrically engageable with a keyway 54 in the front portion of the front core.

Figure 6:
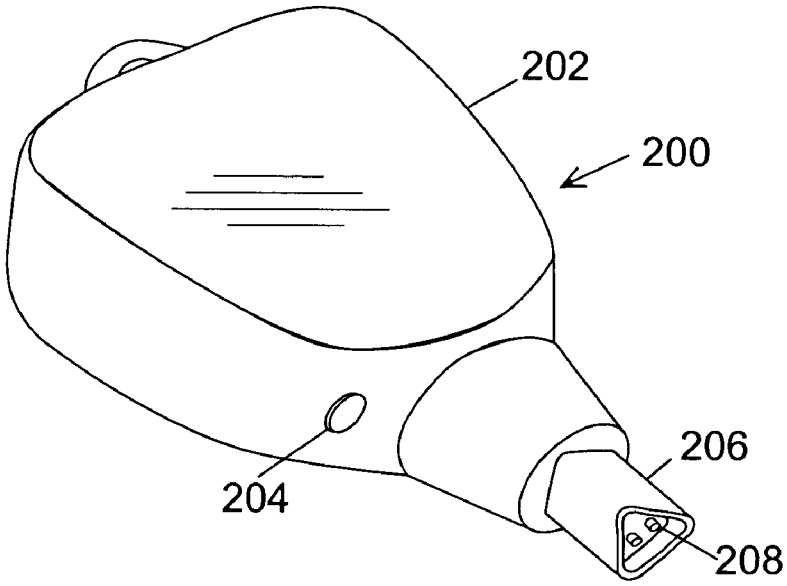
FIG. 6 is a perspective view of a key for use with the lock of FIG. 1.

Referring to FIG. 6, a key 200 for use with the exemplary lock 20 has a housing 202 containing the key's components, typically including a battery and a printed circuit board, including a microprocessor. An LED 204 may also be provided in the key to signal engagement and operation of the lock and key. The key 200 has a nosepiece 206 that is typically polygonal in cross-section and which is engageable with the keyway 54 which comprises a corresponding polygonal relief in the front portion of the front core 52 of the lock. Torque applied to the key by a user is transferred to the core through the meshed polygons defining the mechanical interface of the key and keyway. The keyway 54 is protected from dirt and moisture by a gasket 56 that is secured by a removable cap 58 that is threaded onto the outer shell 26 of the lock.

An electrical interface for the key 200 and the lock 20 is accomplished through corresponding key electrical contacts 208 and lock electrical contacts 70 that are, respectively, located within the peripheries of the key's nosepiece and the lock's keyway. When the nosepiece of the key is inserted into the keyway, springs elastically urge the key's electrical contacts into engagement with the corresponding electrical contacts of the lock. The key's contacts are electrically connected to the key's microprocessor and battery, but insulated from the key's housing. Likewise, the electrical contacts in the keyway are connected to the electrical components of the lock but insulated from the core. The contacts provide an electrical connection between the lock 20 and the key 200, enabling bi-directional data communication and enabling the battery in the key to supply power to the lock's electrical system.

The locking mechanism of a lock commonly includes one or more locking pins movable in the lock's core and engageable with the lock's body, to prevent rotation of the core in the body unless a correctly coded input is received. When the correct input is received, the locking pin(s) is released enabling rotation of the core and release of the shank. The locking mechanism of the exemplary barrel lock 20 is an electro-mechanical system comprising a solenoid assembly, a locking pin 72 and locking pin spring 74. The solenoid assembly including a solenoid coil 76 and a spring loaded, solenoid plunger 78 is centrally mounted in the front core 52. The solenoid plunger 78 is elastically urged to extend from the solenoid coil by a solenoid spring. The solenoid plunger is supported in a plunger guide 80 that has a flange that engages the internal diameter of the front core and an axially extending central sleeve including a central aperture through which the solenoid plunger protrudes. When no power is supplied to the solenoid coil 76, the spring loaded solenoid plunger 78 is urged to extend from the solenoid coil. The plunger 78 interferes with radial displacement of the locking pin in the direction of the center of the core 50. The head portion of the locking pin 72 engages a recess 90A in an axial central aperture of a hollow, cylindrical intermediate shell 90 in which the core is selectively rotatable.

To unlock the lock, a user inserts the nosepiece of the key into the keyway at the front end of the core 50. Data and power are passed between the lock and the key. A printed circuit board 82 that includes a lock microprocessor and a memory is mounted in the front core. The lock microprocessor checks the data received from the key against data in its memory and, if the received data contains the correct code, the microprocessor connects the solenoid to the key's battery causing the solenoid plunger 78 to be drawn toward the solenoid coil 76 and away from the locking pin 72 freeing the locking pin to translate toward the center of the core. When the user turns the key in the keyway 54, a sloping surface on the head portion of the locking pin 72 urges the locking pin toward the center of the core and out of engagement with the recess in the intermediate core.

Locks can be attacked in a number of ways by persons seeking unauthorized access. Mechanical pin tumblers can be picked by inserting a tool into the keyway and manually manipulating the tumbler stacks. While electronic locks are not subject to attack by manual tumbler picking, they can be attacked by other methods, some of which are also used to attack mechanical locks. A lock may be attacked by inserting an object into the keyway and applying torque to the core in an attempt to overload and destroy the locking mechanism. The locking mechanism, including the locking pin and the portion of the body that is engaged by the locking pin, must be sufficiently robust to resist any torque that can be applied to the keyway. Another method of attacking a lock is to drill into the face of the core to destroy the components of the locking mechanism and release the locking pin's engagement with the lock's body.

The present inventor recognized that when the locking mechanism secures rotation of the core relative to the lock's body, the locking mechanism must be strong enough to resist any torque that can be applied to rotate the core. In other words, the components of the locking mechanism must be sufficiently strong to withstand a torque that will cause failure of the stronger of the key or the keyway. However, increasing the strength of the components of the locking mechanism usually requires increasing the size and weight of the lock which is undesirable and can make the lock unsuitable for some applications. Moreover, increasing the strength of the locking mechanism does not improve the lock's security when attacked by drilling into the core.

The inventor also recognized that a drill exerts substantial torque on an object in overcoming the resistance at the cutting edge of the drill bit and, if an equivalent counter-torque is not exerted on the object, the object will rotate with the drill bit and the drill bit will not cut into the surface. The inventor realized that the torque exerted on a lock core by a drilling attack is substantially greater than the torque required to rotate the unlatched core of the lock. Likewise, the maximum torque that can be exerted at the keyway is typically substantially greater than the torque required to rotate the unlatched core. The inventor reasoned that a lock's resistance to drilling and excessive torque could be improved and the size of the lock reduced by limiting the maximum torque that can be exerted on the locking mechanism to a torque sufficient to ensure rotation of the unlatched core.

The shank is released from the body of the lock when the cam surfaces of the core are moved, by rotation of the core, relative to the cam follower ball. On the other hand, the inventor concluded that concurrent rotation of the core and the guide for the cam follower ball would produce equatorial movement of the cam follower ball on the planar, lateral surface of the spider but would not produce the axial displacement of the spider necessary to release the shank. The inventor concluded that by arranging the core to selectively rotate in an intermediate shell that is, in turn, rotatable in the outer shell of the lock and limiting the torque that can be applied to the core to the torque necessary to rotate the unlatched core in the intermediate shell, the lock would be less vulnerable to attacks by either the application of excessive torque to the keyway or drilling.

In the exemplary barrel lock 20, the locking pin 72 is engageable with a recess in the internal diameter of the intermediate shell 90 which comprises a hollow cylinder that is closed at the rear end proximate the spider 40. The intermediate shell is arranged to be rotatable in the outer shell 26 of the lock's body. When the locking pin 72 is in engagement with the intermediate shell 90, the rotational position of the core 50 is fixed relative to the intermediate shell and torque applied to the core causes the core and the intermediate shell to rotate in unison. The cam follower ball 44 is guided in an axial aperture 92 in the end wall of the intermediate shell and, therefore, rotates in unison with the intermediate shell. Since the planar surface of the spider, in contact with the cam follower ball, is arranged normal to the longitudinal axis of the outer shell, the relative positions of the cam surfaces and the cam follower ball do not change during concurrent rotation of the core and the intermediate shell. As a result, the axial positions of the cam follower ball 44 and the spider are unchanged by concurrent rotation of intermediate shell and the core and the state of the shank's engagement will also be unchanged.

Figure 5:
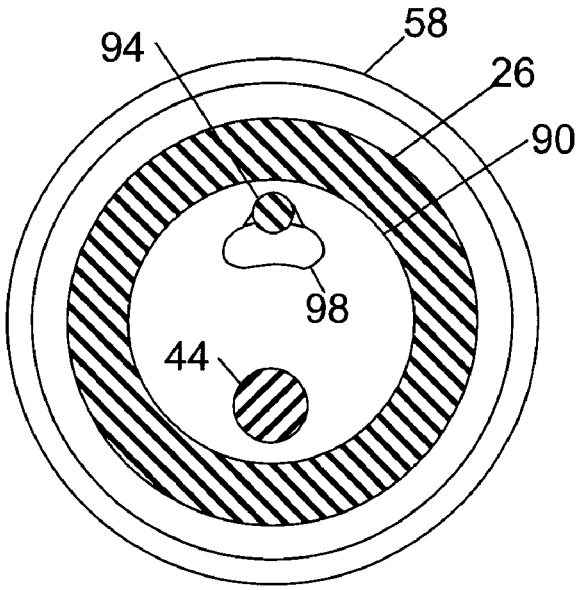
FIG. 5 is a lateral cross section of the lock of FIG. 2 along line 5-5.

When the solenoid is actuated to unlatch the locking mechanism, the core 50 is freed to rotate relative to the intermediate shell 90. A detent resists relative movement of the intermediate shell and the outer shell to assure that the unlatched core will rotate in the intermediate shell before the intermediate shell rotates in the outer shell. A detent member 94, axially movable in an aperture in the socket 28 which is fixed to the outer shell 26, is elastically urged toward the intermediate shell by a detent spring 96. Referring also to FIG. 5, an end portion of the detent member 94 engages a peripheral surface of an aperture 98 in the end wall of the intermediate shell 90. Friction between the detent member and the edge of the aperture exerts sufficient resistance to rotation between the outer shell and the intermediate shell to ensure that the unlatched core will rotate in the intermediate shell before the intermediate shell rotates in the outer shell. On the other hand, the interaction of the surface of the detent member 94 with the surface of the aperture in the intermediate shell delimits the maximum torque that can be applied to the core before the intermediate shell begins to rotate in the outer shell. The interaction of the detent member and the edges of the aperture in the intermediate shell also indexes the angular position of the intermediate shell and, therefore, the latched core relative to the outer shell. While the detent of the exemplary lock 20 is axially movable relative to the socket and the outer core and releasably engages a surface of the intermediate shell, the detent could be arranged to move axially in the intermediate shell and releasably engage a surface of the socket or outer shell.

When the core 50 is rotated relative to the intermediate shell, the cam surfaces 60A, 60B of the core move relative to the cam follower ball 44 and the ball is displaced axially as it moves from the one cam surface to the other. When the ball moves to the cam surface more distal of the socket, the spider return spring 42 displaces the spider 40 toward the front of the lock permitting the relieved second inner surfaces 40D of the spider's axial projections to coincide with the radial apertures 30 in which the shank retaining balls are retained. The shank retaining ball can move radially to accommodate the larger nominal diameter of the shank permitting the shank to be removed from or inserted into the socket. When the cam surface is rotated relative to the cam follower guide so that the cam follower ball 44 is engaged with the cam surface nearer the socket, the cam follower ball is displaced axially toward the rear of the lock. The shank retaining ball 36 can not move radially because of interference with the inner surfaces of the projections of the spider and are trapped in the groove in the shank to secure the shank to the lock's body.

The lock 20 provides superior resistance to attack by the exertion excessive force on the keyway or by drilling into the core by limiting the maximum torque that can be exerted on the locking mechanism and the core to a level that is only sufficient to ensure rotation of the unlatched core. A detent asserts sufficient resistance to rotation to permit the unlatched core to rotate relative to the intermediate shell but limits the maximum torque that can be exerted on the core by a drill or an object engaging the keyway before the intermediate shell is rotated in the outer shell by the core.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

I claim:

1. A lock comprising:

(a) an outer shell having an axis;

(b) an intermediate shell rotatable in said outer shell;

(c) a core selectively rotatable in said intermediate shell; and (d) a shank selectively securable to said outer shell but releasable from said outer shell by rotation of said core in said intermediate shell, said shank not releasable from said outer shell by rotation of said intermediate shell.

2. The lock of claim 1 further comprising a detent delimiting a torque to rotate said intermediate shell in said outer shell.

3. The lock of claim 1 further comprising a detent member translatable relative to one of said outer shell and said intermediate shell and including a portion elastically urged into engagement with a surface of the other of said outer shell and said intermediate shell.

4. The lock of claim 3 wherein said surface comprises a periphery of a portion of one of said outer shell and said intermediate shell defining an aperture.

5. The lock of claim 1 further comprising:

(a) a spider movable axially in said outer shell to release said shank and including a planar surface arranged substantially normal to said axis;

(b) a cam comprising a first cam surface and a second cam surface axially displaced from said first cam surface, said cam rotatable with said core; and (c) a cam follower arranged for contact with said planar surface of said spider and, alternatively, one of said first cam surface and said cam second surface, said cam follower rotatable with said intermediate shell.

6. The lock of claim 5 further comprising a detent member translatable relative to one of said outer shell and said intermediate shell and including a portion elastically urged into releasable engagement with a detenting surface of the other of said outer shell and said intermediate shell.

7. The lock of claim 6 wherein said detenting surface comprises a portion of one of said outer shell and said intermediate shell defining a periphery of an aperture.

8. A lock comprising:

(a) an elongate outer shell having a longitudinal axis;

(b) a shank selectively securable in said outer shell;

(c) an elongate intermediate shell housed within said outer shell and rotatable relative to said outer shell;

(d) a detent releasably engageable with one of said outer shell and said intermediate shell to delimit a torque to rotate said intermediate shell in said outer shell;

(e) an elongate core housed within said intermediate shell and arranged to rotate relative to said intermediate shell, said core including a cam comprising a first surface and an axially displaced second surface;

(f) a locking mechanism selectively movable to engage said intermediate shell and interfere with rotation of said core in said intermediate shell and, alternatively, disengage said intermediate shell and permit rotation of said core in said intermediate shell;

(g) a cam follower in contact with one of said first surface and said second surface of said cam and movable axially by rotation of said core in said intermediate shell; and (h) a spider housed within and axially movable with respect to said outer shell by said cam follower to release said shank from said outer shell.

9. The lock of claim 8 wherein said detent comprises a detent member translatable in one of said outer shell and said intermediate shell and including a portion elastically urged into releasable engagement with a detenting surface of the other of said outer shell and said intermediate shell.

10. The lock of claim 9 wherein said detenting surface comprises a periphery of a portion defining an aperture in one of said intermediate shell and a portion of said lock affixed relative to said outer shell.

11. A lock comprising:

(a) a shank including portions defining a groove;

(b) a hollow elongate outer shell having a longitudinal axis;

(c) a socket secured in said outer shell, said socket including portions defining an axially extending aperture to receive said shank and a radially extending aperture;

(d) a shank retaining ball movable in said radially extending aperture to selectively engage said groove in said shank;

(e) a spider including a first surface and a second surface, said spider movable axially in said outer shell from a first position where said first surface is arranged to block a movement of said shank retaining ball to a second position where said second surface is arranged to permit said movement of said shank retaining ball;

(f) an elongate intermediate shell housed within and rotatable with respect to said outer shell;

(g) an elongate core housed within and rotatable with respect to said intermediate shell and including a cam comprising a first cam surface and a second cam surface axially displaced from said first surface;

(h) a locking mechanism selectively movable with respect to said core to engage said intermediate shell and interfere with rotation of said core in said intermediate shell and, alternatively, to disengage said intermediate shell to permit rotation of said core in said intermediate shell; and (i) a cam follower in contact with a surface of said cam and a surface of said spider and movable axially by rotation of said core in said intermediate shell to axially displace said spider.

12. The lock of claim 11 further comprising a detent delimiting a torque to rotate said intermediate shell in said outer shell.

13. The lock of claim 11 further comprising a detent member movable in a portion of one of said socket and said outer shell defining an aperture and including a portion elastically urged into contact with a surface of said intermediate shell to limit a torque required to rotate said intermediate shell in said outer shell.

14. The lock of claim 11 further comprising a detent member movable in a portion of said intermediate shell defining an aperture and including a portion elastically urged into contact with a surface of one of said socket and said outer shell to limit a torque required to rotate said intermediate shell in said outer shell.

15. A method for resisting an attack on a lock having a shank selectively securable to an outer shell and releasable from said outer shell by rotation of a core, said method comprising the steps of:

(a) arranging an intermediate shell to rotate in said outer shell of said lock; and (b) arranging said core to selectively rotate in said intermediate shell, rotation of said core relative to said intermediate shell releasing a said shank from securement to said outer shell, said shank not releasable from said outer shell by concurrent rotation of said intermediate shell and said core.

16. The method of claim 15 further comprising the step of imposing a resistance to rotation of said intermediate shell in said outer shell, said resistance being sufficient to enable relative rotation of said core in said intermediate shell when rotation of said core is by a locking mechanism and insufficient to rotate said core in said intermediate shell when rotation of said core is not enabled by said locking mechanism.

* * * * *